US012312917B2

(12) United States Patent
Ardic et al.

(10) Patent No.: US 12,312,917 B2
(45) Date of Patent: May 27, 2025

(54) ELECTRIC TOP DRIVE

(71) Applicant: Nabors Drilling Technologies USA, Inc., Houston, TX (US)

(72) Inventors: Hifzi Ardic, Houston, TX (US); Faisal Yousef, Katy, TX (US); Edward Bluestone, Houston, TX (US); James M. Hall, Spring, TX (US); Ryan Belanger, Spring, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 231 days.

(21) Appl. No.: 17/815,293

(22) Filed: Jul. 27, 2022

(65) Prior Publication Data

US 2023/0040156 A1 Feb. 9, 2023

Related U.S. Application Data

(60) Provisional application No. 63/260,098, filed on Aug. 9, 2021.

(51) Int. Cl.
*E21B 4/04* (2006.01)
*E21B 19/16* (2006.01)

(52) U.S. Cl.
CPC ..... *E21B 4/04* (2013.01); *E21B 19/164* (2013.01)

(58) Field of Classification Search
CPC .... E21B 19/161; E21B 19/162; E21B 19/163; E21B 19/164; E21B 4/04
See application file for complete search history.

(56) References Cited

U.S. PATENT DOCUMENTS

| | | | | |
|---|---|---|---|---|
| 8,843,220 | B1 | 9/2014 | Rembach et al. | |
| 9,790,751 | B2 | 10/2017 | Reddy et al. | |
| 10,132,126 | B2 | 11/2018 | Helms et al. | |
| 10,309,166 | B2 | 6/2019 | Thiemann et al. | |
| 10,465,457 | B2 | 11/2019 | Hebebrand et al. | |
| 10,486,753 | B2 | 11/2019 | Eppright | |
| 10,718,162 | B2 | 7/2020 | Van Duivendijk et al. | |
| 11,041,345 | B2 | 6/2021 | Wijning et al. | |
| 2005/0077084 | A1 | 4/2005 | Kracik et al. | |
| 2009/0151934 | A1* | 6/2009 | Heidecke | E21B 19/16 166/380 |
| 2009/0183923 | A1 | 7/2009 | Williams et al. | |
| 2015/0107850 | A1* | 4/2015 | Mosing | E21B 19/164 81/57.16 |
| 2016/0145954 | A1* | 5/2016 | Helms | E21B 19/06 175/57 |
| 2016/0215592 | A1 | 7/2016 | Helms et al. | |
| 2017/0044875 | A1* | 2/2017 | Hebebrand | E21B 47/13 |

(Continued)

FOREIGN PATENT DOCUMENTS

| | | | |
|---|---|---|---|
| CA | 2780097 | A1 | 4/2007 |
| EP | 3615762 | A1 | 3/2020 |

(Continued)

*Primary Examiner* — Tara Schimpf
*Assistant Examiner* — Lamia Quaim
(74) *Attorney, Agent, or Firm* — Abel Schillinger, LLP

(57) ABSTRACT

A top drive that can include a main body portion having a quill that is rotatable relative to the main body portion, a rotary portion that rotates relative to the main body portion and relative to the quill, and a component coupled to the rotary portion, wherein the component rotates with the rotary portion, and wherein the component is electrically actuated.

20 Claims, 11 Drawing Sheets

(56) References Cited

U.S. PATENT DOCUMENTS

| | | | | |
|---|---|---|---|---|
| 2017/0067320 | A1 | 3/2017 | Zouhair et al. | |
| 2018/0245445 | A1 | 8/2018 | Theis et al. | |
| 2019/0039857 | A1* | 2/2019 | Vierke | B66B 1/3461 |
| 2019/0048671 | A1* | 2/2019 | Wern | E21B 19/164 |
| 2019/0085639 | A1 | 3/2019 | Wern et al. | |
| 2019/0203535 | A1* | 7/2019 | Yousef | F16C 19/364 |

FOREIGN PATENT DOCUMENTS

| | | | |
|---|---|---|---|
| SG | 166124 | A1 | 11/2010 |
| WO | 8902973 | A1 | 4/1989 |
| WO | 2013173101 | A2 | 11/2013 |
| WO | 2016085821 | A2 | 6/2016 |
| WO | 2017027647 | A1 | 2/2017 |
| WO | 2017044482 | A1 | 3/2017 |
| WO | 2017065603 | A1 | 4/2017 |
| WO | 2018199751 | A1 | 11/2018 |

* cited by examiner

ELECTRIC TOP DRIVE

CROSS-REFERENCE TO RELATED APPLICATION(S)

This application claims priority under 35 U.S.C. § 119(e) to U.S. Patent Application No. 63/260,098, entitled "AN ELCTRIC TOP DRIVE," by Hifzi ARDIC et al., filed Aug. 9, 2021, which application is assigned to the current assignee hereof and incorporated herein by reference in its entirety.

TECHNICAL FIELD

The present invention relates, in general, to the field of drilling and processing of wells. More particularly, present embodiments relate to a system and method for electrically operating one or more components of a top drive that are below the handler rotate motor during subterranean operations.

BACKGROUND

Hydraulic systems are used on most rigs to perform control and actuation of equipment during subterranean operations. These hydraulic systems have been very effective in providing control for rig operations. However, most hydraulic systems suffer from the resulting mess when leaks occur, equipment is replaced or repaired, etc. Therefore, improvements in rig systems are continually needed.

SUMMARY

One general aspect includes a top drive that can include a main body portion and a quill that is rotatable relative to the main body portion; a rotary portion that rotates relative to the main body portion and relative to the quill; and a component coupled to the rotary portion, where the component rotates with the rotary portion, and where the component is an electrically actuated system for performing subterranean operations.

One general aspect includes a system with a top drive slidably coupled to a rig, where the top drive is any one of the top drives described in this disclosure.

One general aspect includes a method for performing a subterranean operation. The method can include electrically operating a top drive to perform the subterranean operation, with the top drive being any one of the top drives described in this disclosure.

BRIEF DESCRIPTION OF THE DRAWINGS

These and other features, aspects, and advantages of present embodiments will become better understood when the following detailed description is read with reference to the accompanying drawings in which like characters represent like parts throughout the drawings, wherein.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. It should be understood that the various embodiments described herein are not mutually exclusive. The elements in one embodiment can also be used in other embodiments.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of the word "about," "approximately," or "substantially" is intended to mean that a value of a parameter is close to a stated value or position. However, minor differences may prevent the values or positions from being exactly as stated. Thus, differences of up to ten percent (10%) for the value are reasonable differences from the ideal goal of exactly as described. A significant difference can be when the difference is greater than ten percent (10%).

As used herein, "tubular" refers to an elongated cylindrical tube and can include any of the tubulars manipulated around a rig, such as tubular segments, tubular stands, tubulars, and tubular string. Therefore, in this disclosure, "tubular" is synonymous with "tubular segment," "tubular stand," and "tubular string," as well as "pipe," "pipe segment," "pipe stand," "pipe string," "casing," "casing segment," or "casing string."

Figure 1A:
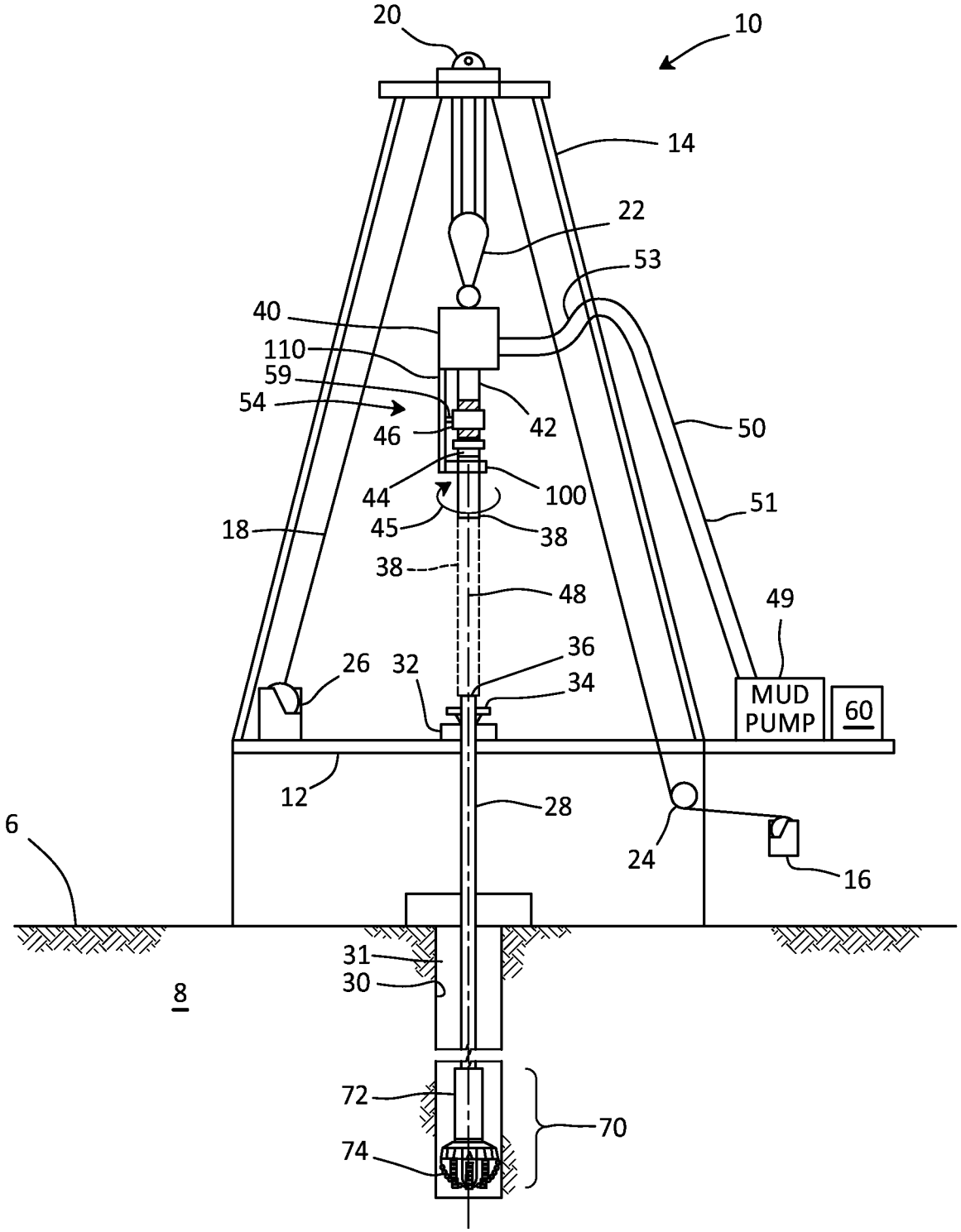
FIG. 1A is a representative partial cross-sectional view of a rig using a top drive during a subterranean operation, in accordance with certain embodiments.

Turning now to the drawings, FIG. 1A is a schematic of a drilling rig 10 in the process of drilling a well, in accordance with present techniques. The drilling rig 10 features an elevated rig floor 12 and a derrick 14 extending above the rig floor 12. A supply reel 16 supplies drilling line 18 to a crown block 20 and traveling block 22 configured to hoist various types of drilling equipment above the rig floor 12. The drilling line 18 is secured to a deadline tiedown anchor 24, and a drawworks 26 regulates the amount of drilling line 18 in use and, consequently, the height of the traveling block 22 at a given moment. Below the rig floor 12, a tubular string 28 extends downward into a wellbore 30 and can be held stationary with respect to the rig floor 12 by a rotary table 32 or slips 34. A portion of the tubular string 28 extends above the rig floor 12, forming a stickup 36 to which another length of tubular 38 may be added.

When a new length of tubular 38 is added to the tubular string 28, a pipe handler (not shown) can position the tubular 38 over the stickup 36 and connect the new tubular 38 to the stickup 36. A top drive 40, raised and lowered by a traveling block 22, can be lowered to engage with the top of the tubular 38. The top drive 40 can utilize a grabber system 54 to hold the tubular 38 while the top drive 40 is coupled to the tubular. The grabber system 54 may include a positioner 110 coupled to the top drive 40, a backup wrench 100 coupled to the end of the positioner 110 and configured to grab the tubular 38, and a mud saver valve support 59 configured to couple a mud saver valve 46 to the positioner 110.

The backup wrench 100 can grip the tubular 38 so the top drive 40 can threadably engage the tubular 38 with the sub saver 44 (in this example). As the tubular 38 is lowered, the top drive 40 may rotate the tubular 38 (arrows 45). Specifically, the top drive 40 can include a quill 42, a mud saver valve 46, and a saver sub 44 (e.g., a crossover sub), used to turn the tubular 38. The tubular 38 may be coupled to the saver sub 44, which can be coupled to the mud saver valve 46, which is in turn can be coupled to the top drive 40 via the quill 42. In certain embodiments, the mud saver valve 46 may include threads on both axial ends to couple to the saver sub 44 and the quill 42.

Furthermore, the top drive 40 can couple with the tubular 38 in a manner that enables translation of motion to the tubular 38. Indeed, in the illustrated embodiment, the top drive 40 is configured to supply torque for making up and breaking out a coupling between the tubular 38 and the stickup 36. However, torque for making up and breaking out a coupling between the tubular 38 and the stickup 36 can alternatively, or in addition to, be supplied by other equipment, such as a pipe handler (not shown) or an iron roughneck (not shown).

To facilitate the circulation of mud or other drilling fluid within the wellbore 30, the drilling rig 10 includes a mud pump 49 configured to pump mud or drilling fluid up to the top drive 40 through a mud hose 50. In certain embodiments, the mud hose 50 may include a standpipe 51 coupled to the derrick 14 in a substantially vertical orientation to facilitate pumping the mud. The standpipe 51 provides a high-pressure path for mud to flow up the derrick 14 to the top drive 40. From the mud hose 50 (e.g., standpipe 51), the mud flows through a kelly hose 53 to the top drive 40. From the top drive 40, the drilling mud will flow through internal passages of the mud saver valve 46, into internal passages of the tubular 38 and the tubular string 28, and into the wellbore 30 at the bottom of the well. The drilling mud flows within the wellbore 30 (e.g., in an annulus 31 between the tubular string 28 and the wellbore 30) and back to the surface where the drilling mud may be recycled (e.g., filtered, cleaned, and pumped back up to the top drive 40 by the mud pump 49).

When a new length of tubular 38 is to be added to the tubular string 28, mud flow from the mud pump 49 and the mud hose 50 can be stopped, and the top drive 40 decoupled from the tubular string 28 (i.e., the length of the tubular 38 that was most recently added to the tubular string 28). When the top drive 40 releases the tubular string 28, mud within the top drive 40 may run out of the top drive 40 and onto the rig floor 12. To avoid spilling mud onto the rig floor 12, the mud saver valve 46 can be included to block mud from inadvertently flowing out of the top drive 40 when the mud pump 49 is not pumping mud. When the top drive 40 is thereafter coupled to a new length of tubular 38 and the mud pump 49 resumes a pumping operation, the mud saver valve 46 may enable flow of mud through the mud saver valve 46 and the top drive 40 to the tubular 38 and tubular string 28. A rig controller 60 can be used to control the subterranean operation, by controlling mud flow through the top drive 40 and tubular string 28, controlling top drive operation, and receiving sensor data from various sensors. The tubular string 28 can include a bottom hole assembly BHA 70 that can include a drill bit 74 attached to one or more drill collars 72 to extend the wellbore 30 into the formation 8.

Figure 1B:
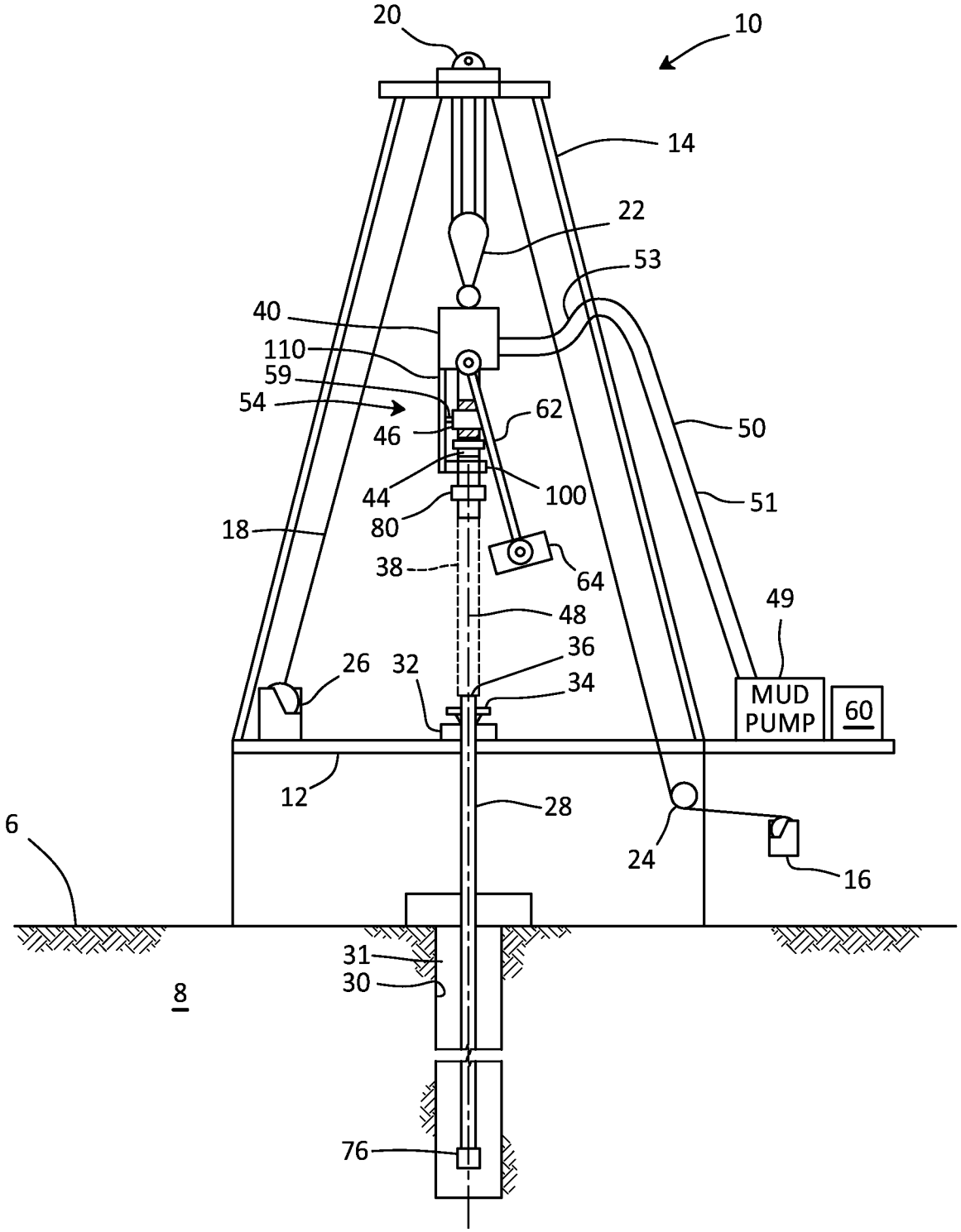
FIG. 1B is a representative partial cross-sectional view of a rig using a top drive, a casing running tool, and an elevator during a subterranean operation, in accordance with certain embodiments.

FIG. 1B is a representative partial cross-sectional view of a rig 10 using a top drive 40, a running tool 80, and an elevator 64 during a subterranean operation to manipulate the tubular string 28. In a non-limiting embodiment, the rig 10 is shown in FIG. 1B is very similar to the rig 10 in FIG. 1A except that it may be manipulating a casing string (e.g., the tubular string 28) with an elevator 64 to lift or lower a tubular 38 (or tubular string 28) during the subterranean operations (e.g., running a casing string). It should be understood that the elevator 64 and running tool 80 can also be used for tubular strings 28 other than a casing string.

The elevator 64 can be used to collect a tubular 38 from a pipe handler (e.g., catwalk) and lift it to be vertically positioned over the stickup 36. The top drive 40 (via the traveling block) can be lowered to lower the tubular 38 onto the stickup 36 and further lowered to insert the running tool 80 into the top of the tubular 38. The top drive 40 can operate the running tool 80 to engage the tubular 38, such as by holding a stationary portion of the running tool 80 via the backup wrench 100 and rotating a rotary portion of the running tool 80 via the quill 42 to radially expand the running tool 80 within the tubular 38. The running tool 80 can then rotate the tubular 38 to couple the tubular 38 to the stickup 36. The top drive 40 can then be lowered to lower the tubular string 28 further into the wellbore 30 until the tubular string 28 is at the correct stickup height. The top drive 40 can then disengage the running tool 80 from the tubular 38, the elevator 64 can engage a new tubular 38, and the top drive 40 can be raised to an appropriate height to repeat the process to add the new tubular 38 to the tubular string 28.

Figure 2:
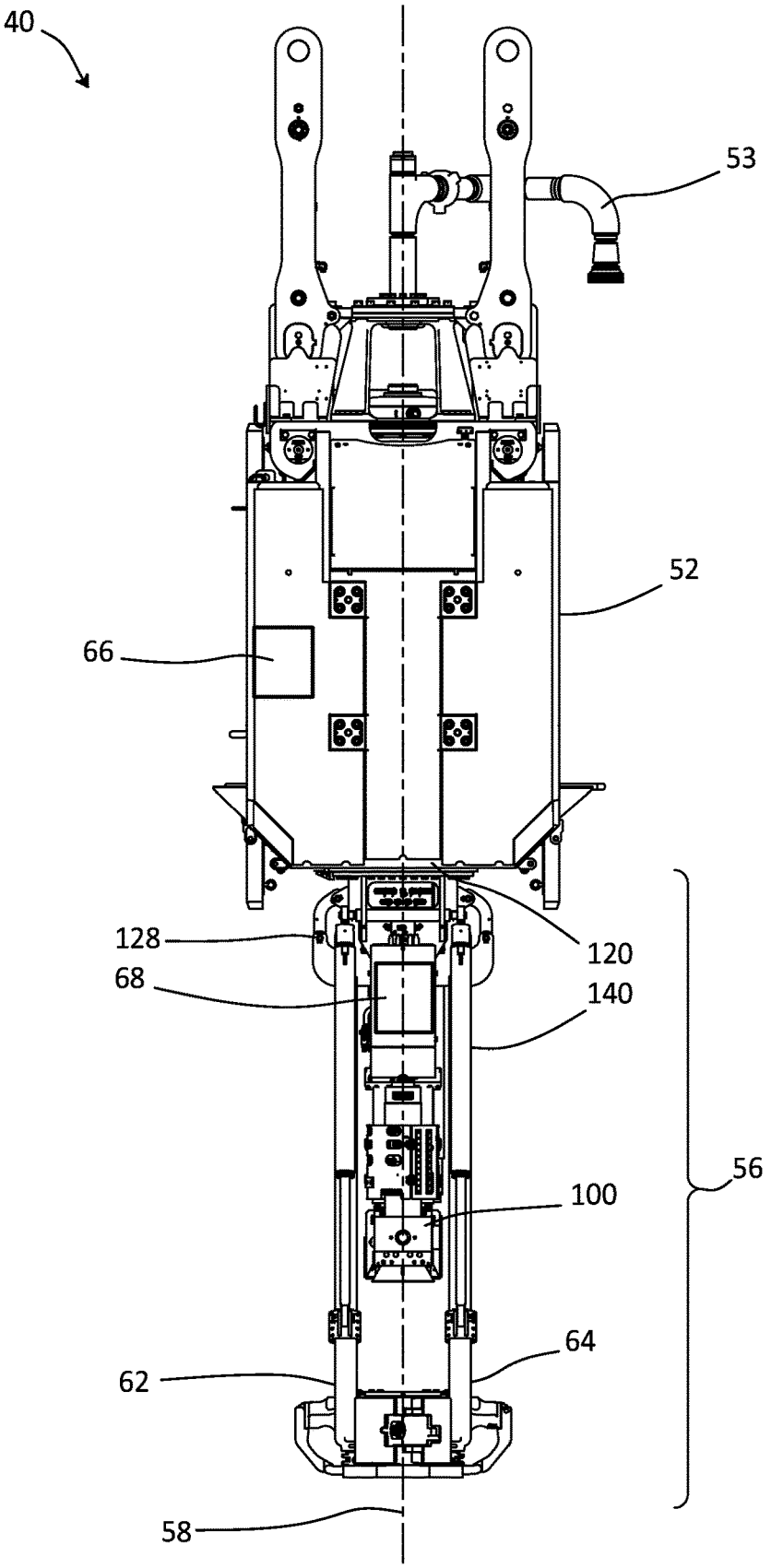
FIG. 2 is a representative front view of a top drive, in accordance with certain embodiments.

FIG. 2 is a representative front view of a top drive 40 that minimizes the use of hydraulic components and replaces these hydraulic components with appropriate electrical components to perform the necessary functions previously performed by the hydraulic components. The inventors discovered that providing the necessary power to run the components of the top drive exceeded the electrical power currently supplied to the rotary portion 56 of the top drive 40, where the rotary portion 56 is defined as those components of the top drive 40 or components coupled to the top drive 40 below the handler motor 120. The handler motor 120 is configured to rotate the rotary portion 56 relative to the main body 52 of the top drive 40. Rotation of the rotary portion is generally used to align the elevator 64 with tubulars 38 as the elevator 64 is positioned to engage a tubular 38. In this embodiment, the elevator 64 can be coupled to a pair of links 62, which are coupled to a link support 128. Link tilt actuators 140 can be used to rotate the link pair 62 about the link support 128, thereby tilting the link pair 62 (and thus the elevator 64) toward/away from the center axis 58 of the quill 42 (and the tubular string 28 when coupled to the top drive 40).

The rig controller 60 can use a local controller 66 to control operation of the top drive 40 as well as another local controller 68 to control the operation of the components in the rotary portion 56 of the top drive 40. Communication between the controller 68 and the controllers 60, 66 can be provided through an induction ring positioned between the main body 52 and the rotary portion 56. The induction ring (not shown) can provide electrical communication between the controllers to control the top drive 40. The controller 68 can be used to control actuation of the electrical actuators in the rotary portion 56.

Figure 3A:
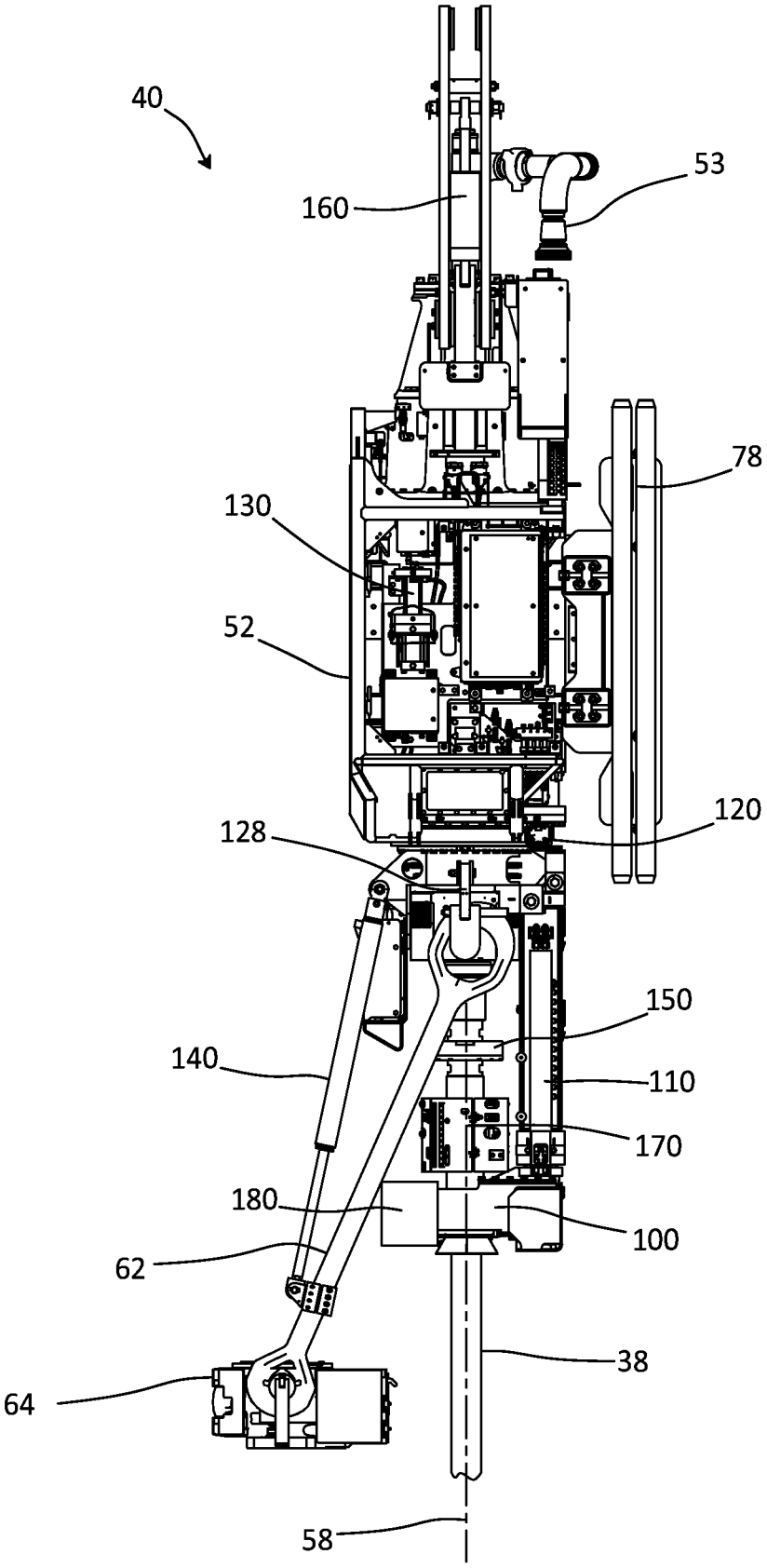
FIG. 3A is a representative side view of the top drive with an elevator tilted away from a tubular; in accordance with certain embodiments.

FIG. 3A is a representative side view of the top drive 40 with an elevator 64 tilted away from a tubular 38 and the center axis 58. In a non-limiting embodiment, a generator 180 in the form of a hydraulically powered electric generator can be positioned below the handler motor 120 to provide necessary electric energy for powering electric components, such as the link tilt actuators 140, the backup wrench 100, the backup wrench positioners 110, the lower well control valve (LWCV) 170, and the elevator 64 (as well as a running tool 80 in other embodiments). The generator 180 can receive pressurized hydraulic fluid from a rotary fluid manifold that can supply hydraulic fluid to the generator 180 below the handler motor 120. The output of the generator 180 can be electrically coupled to the electric components for operating the top drive 40 components. In this non-limiting embodiment, the generator 180 can be disposed on the backup wrench 100. However, the generator 180 can be positioned at other locations below the handler motor 120, such as on the elevator 64. Electrical conductors can be routed appropriately on or through the components in the rotary portion 56 of the top drive 40 to electrically couple the electric components to the electric power source (e.g., the generator 180). The controller 68 can control actuation of these components to operate the top drive 40.

To further reduce the hydraulic components in the top drive 40, the thread compensator actuators can be replaced with electric actuators 160. The thread compensator actuators 160 can be used to allow upward to downward travel of the top drive 40 due to threading operations. Also, the brake actuator can be replaced with an electric actuator 130. The brake actuator 130 can be used to selectively restrict rotation of the quill 42. The actuators 130, 160 can receive electrical power directly from the top drive main body 52 components since they are not located in the rotary portion 56 of the top drive 40.

Figure 3B:
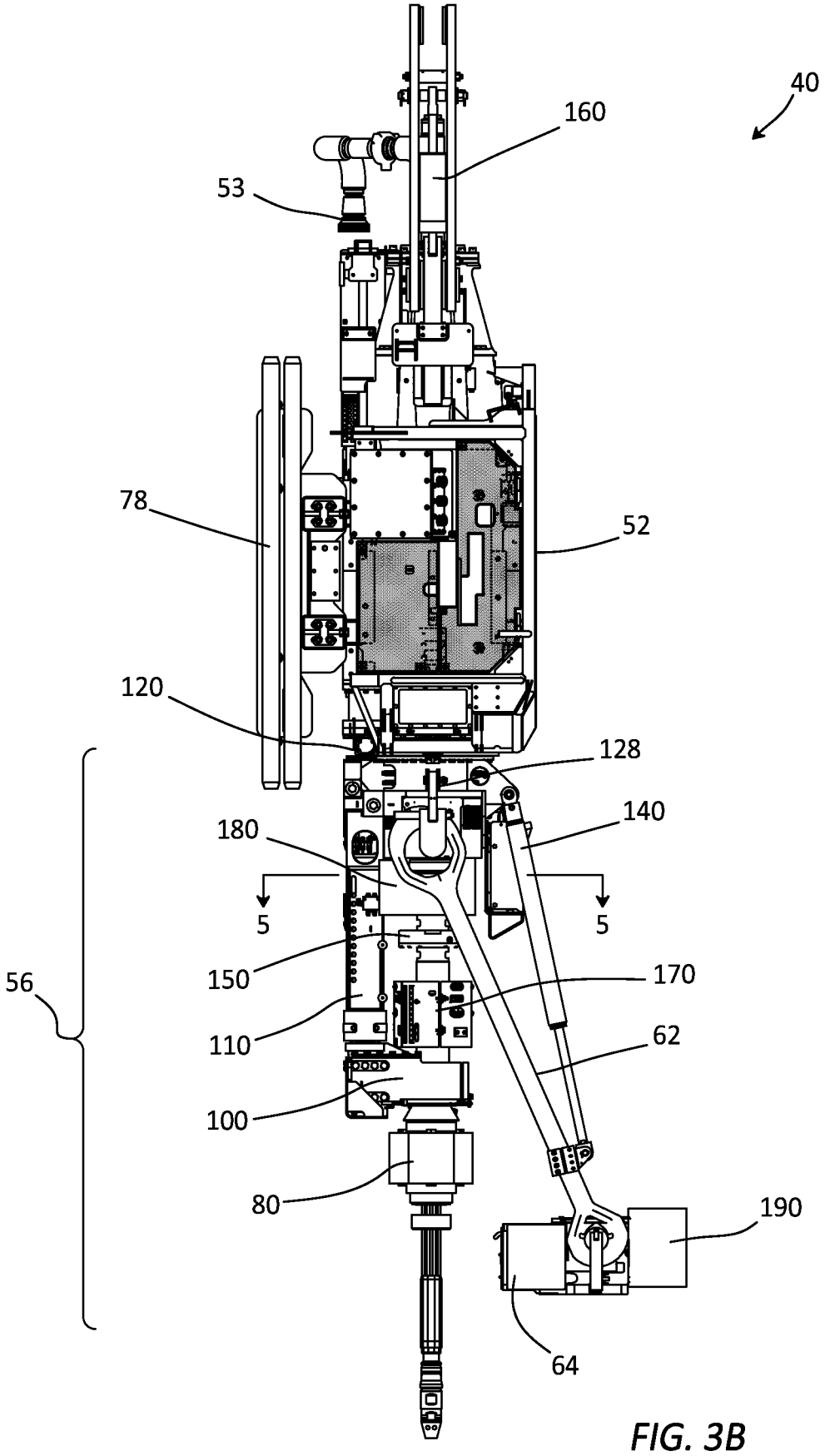
FIG. 3B is another representative side view of the top drive coupled to a running tool; in accordance with certain embodiments.

FIG. 3B is a representative side view of the top drive 40 coupled to a running tool 80, with the backup wrench engaged with a stationary portion of the running tool 80 and the quill 42 (e.g., through the TESTTORK™ sub 150 and the LWCV 170) is coupled to the rotary portion of the running tool 80. In this non-limiting embodiment, a stationary portion of a generator 180 can be coupled to the backup wrench positioner 110, with a rotary portion of the generator 180 driven by the quill 42 to generate electric energy for powering electrical components of the top drive 40 in the rotary portion 56.

The generator 180 can generate power while the quill 42 is rotating relative to the body 52 of the top drive 40. However, when a tubular 38 is being added or removed from the tubular string 28, the quill is not rotated until the connection/disconnection of the tubular 38 is complete. Since the components of the top drive in the rotary portion 56 are generally needed when the tubular 38 is being connected or disconnected, the top drive 40 may need an energy storage system ESS 190 that can store enough electric energy to operate the components of the top drive in the rotary portion 56. The ESS 190 can be a battery or capacitors or combinations thereof for storing generated electrical energy. The ESS 190 can include a controller for managing charging/discharging as well as reporting health status to the rig controller 60. The ESS 190 can be positioned at various locations in the rotary portion 56. However, for discussion purposes, the ESS 190 is disposed on the elevator 64 in this example. Conductors 186 (see FIG. 5) can be used to electrically couple the generator 180 to the ESS 190 for storage of electrical energy. The ESS 190 and the generator 180 can be electrically coupled to the backup wrench 100, the backup wrench positioner 110, the link tilt actuators 140, the LWCV 170, the running tool 80, and the elevator 64. The ESS 190 can be configured to provide power to the top drive components for the time needed to make one, two, three, four, or more connections/disconnections of a tubular 38. In between connection/disconnection times, the quill 42 can be rotated to generate electricity for charging the ESS 190. If the ESS 190 indicates to the rig controller 60 (or another local controller) that it is below a desired power level, then the quill 42 can be rotated to generate power via the generator 180 and charge the ESS 190.

The generator 180, the LWCV 170, and the running tool 80 have a stationary portion that can be coupled to the backup wrench 100 or backup wrench positioner 110 to prevent rotation relative to the backup wrench 100. They also can each include a rotary portion that is coupled to the quill 42 and rotates with the quill 42 relative to the stationary portions. Electrical conductors can be routed appropriately on or through the components in the rotary portion 56 of the top drive 40 to electrically couple the electric components (e.g., electric linear actuators) to the electric power source (e.g., the generator 180 or the ESS 190). The controller 68 can control actuation of these components to operate the top drive 40.

Figure 4A:
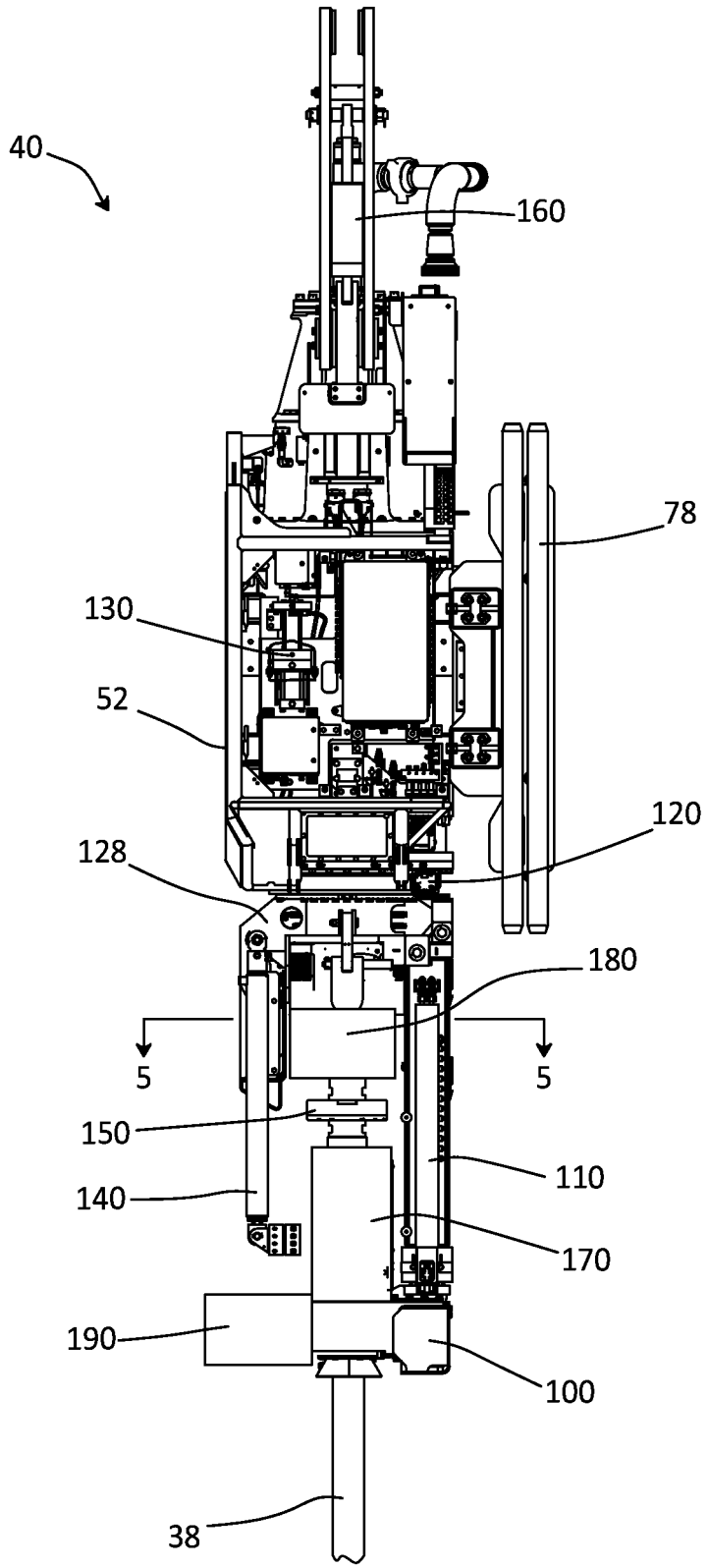
FIG. 4A is a representative side view of a top drive; in accordance with certain embodiments.

FIG. 4A is a representative partial cross-sectional side view of a top drive 40 which is similar to the top drive 40 shown in FIG. 3B, except that the link pair 62 and elevator 64 are removed for clarity, and the ESS 190 is positioned on the backup wrench 100, instead of the elevator 64. The generator 180 generates electrical energy from rotation of the quill and stores the electrical energy in the ESS 190 for later use.

Figure 4B:
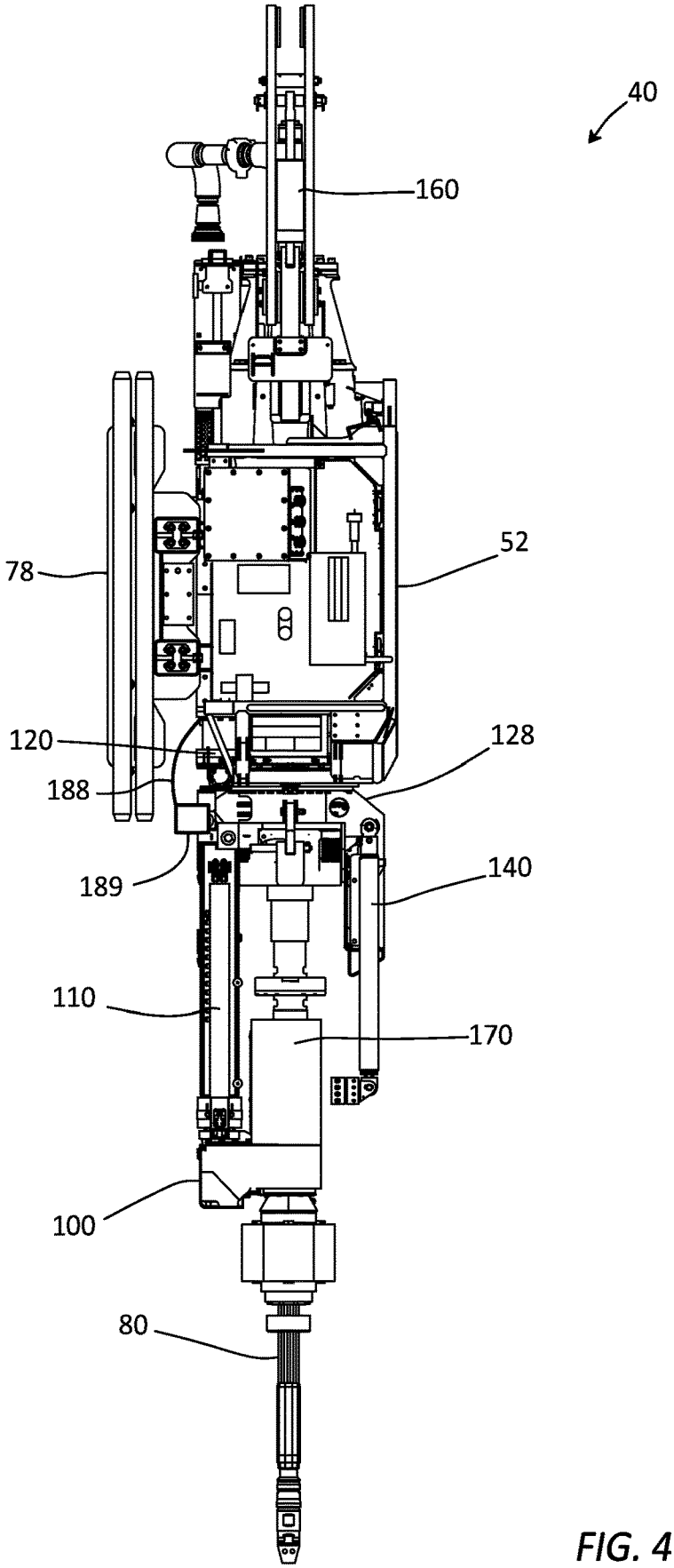
FIG. 4B is another representative side view of the top drive coupled to a running tool; in accordance with certain embodiments.

FIG. 4B is another representative partial cross-sectional side view of the top drive 40 coupled to a running tool 80. In this non-limiting embodiment, electric power is provided from the main body 52 to the rotary portion 56 via electrical conductors 188. These conductors 188 jumper around the handler motor 120 to provide power to the components of the top drive 40 in the rotary portion 56. Since the conductors 188 are physically coupled between the main body 52 and the rotary portion 56, the rotary portion 56 is not permitted to rotate more than 359 degrees. This prevents the rotary portion 56 from rotating more than a service loop in the conductor 188 allows. By preventing the rotary portion 56 from rotating more than 359 degrees, this can ensure the conductors 188 will not be damaged due to over-extension. The conductors 188 can be rated to carry the necessary power to the components of the top drive in the rotary portion 56. The conductors 188 can include conductors for carrying power, or command and status signals.

The conductors 188 can include a connector 189 for connecting and disconnecting the conductors 188 from the rotary portion 56. With the connector 189 disconnected, the rotary portion 56 can rotate up to and greater than 360 degrees. With the conductors 188 connected to the rotary portion 56 via the connector 189, then the one or more of the controllers 60, 66, 68 can control the rotary portion 56 to allow rotation only up to and not exceeding 359 degrees to prevent over-extension of the conductors 188. The conductors 188 with connector(s) 189 can be used with any of the other top drive configurations (e.g., FIGS. 3A, 3B, 4A) as well. For example, if the generator 180 fails to supply power to the components of the rotary portion 56, then the conductors 188 can be connected to the rotary portion 56 to supply power to the components of the rotary portion 56 as a backup source of power. The conductors 188 can also include signal paths for command, control, and data signals to communicatively couple the components of the rotary portion 56 to the controllers 60, 66. When the generator 180 is repaired or replaced, the conductors 188 can be disconnected from the rotary portion 56, and one or more of the controllers 60, 66, 68 can again allow the rotary portion 56 to rotate up to and greater than 360 degrees.

Figure 5:
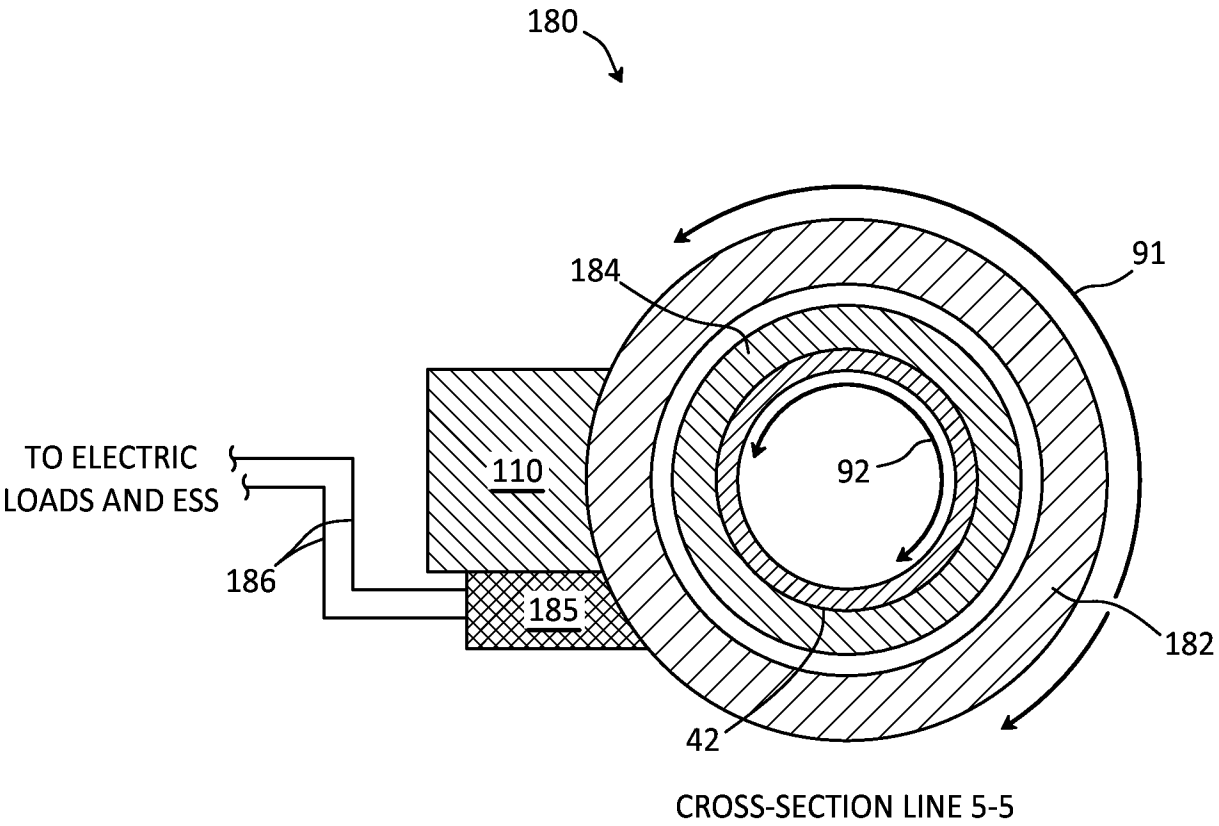
FIG. 5 is a representative partial cross-sectional view along section line 5-5, as indicated in FIGS. 3B and 4A, of a generator for the top drive, in accordance with certain embodiments.

FIG. 5 is a representative partial cross-sectional view along section line 5-5, as indicated in FIG. 2A, of a generator 180 of electric power for the components of the top drive 40 in the rotary portion 56. In a non-limiting embodiment, a rotor 184 of the generator 180 can be fixedly attached to the quill 42 or a sub coupled to the quill 42. The rotor 184 can include windings (and possibly magnets) for inducing current in the stator 182. The rotor 184 can rotate (arrows 92) relative to the stator 182 when the quill 42 is rotated. Due to the rotation of the rotary portion 56 of the top drive 40, the stator 182, which can be fixedly coupled to the backup wrench positioner 110, can also be rotated (arrows 91) relative to the main body 52 of the top drive 40. However, since the quill 42 rotates at higher speeds, then the generator 180 can be used to generate electrical power to power the components in the rotary portion 56. The conductors 186 can be used to deliver the generated power to the components in the rotary portion 56, such as the ESS 190 for storing the power for later use. The circuitry 185 can be used to provide signal conditioning of the generated power as well as communicating generator 180 status to the rig controller 60 (or other controllers 66, 68). Rotation of the rotary portion 56 is normally used to align a pipe handling means (such as an elevator 64) with tubulars 38 to be engaged. In this embodiment, the rotary portion 56 is enabled to rotate more than 360 degrees (even multiple rotations) relative to the body 52 of the top drive 40.

Figure 6B:
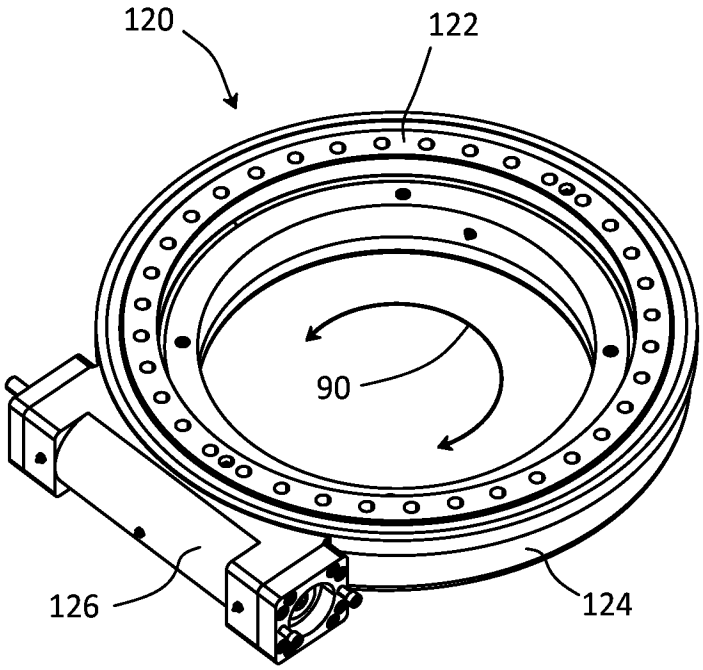
FIG. 6B is a representative perspective bottom view of the handler motor, in accordance with certain embodiments.
Figure 6A:
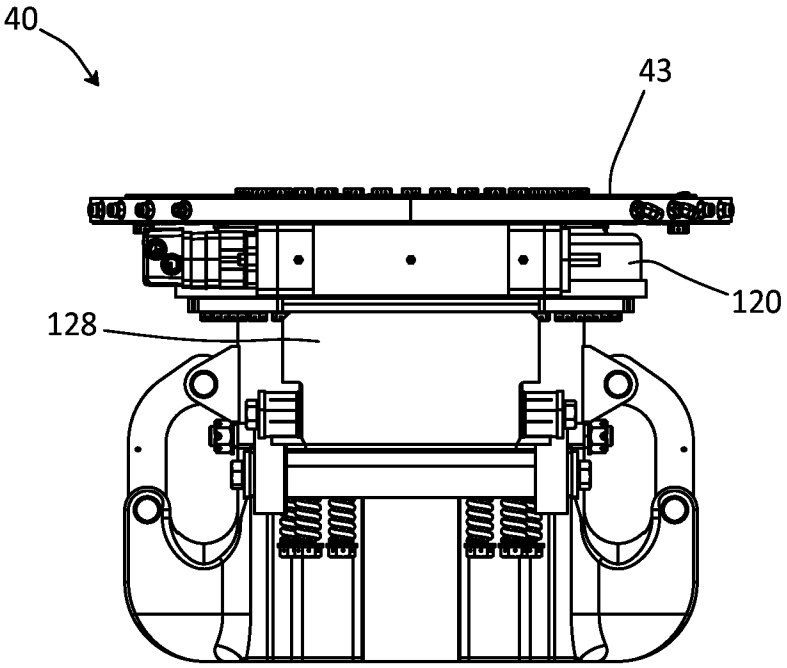
FIG. 6A is a representative front view of a link support rotatably coupled to the top drive via a handler motor, in accordance with certain embodiments.

FIG. 6A is a representative front view of a link support 128 rotatably coupled to the top drive 40 via a handler motor 120 and a top drive interface 43. The link support 128 can be rotated relative to the top drive interface 43 via actuation of the handler motor 120.

FIG. 6B is a representative perspective bottom view of the handler motor 120. The body 124 of the handler motor 120 can be attached to the top drive interface 43 and the rotation ring 122 can be attached to the link support 128. The motor 126 (which can be electrically powered), when actuated, can cause the rotation ring 122 to rotate relative to the body 124. Therefore, when installed in the top drive 40 as in FIG. 6A, the actuation of the motor 126 can cause the link support 128 to rotate (arrows 90) relative to the top drive interface 43.

Figures 7A, 7B:
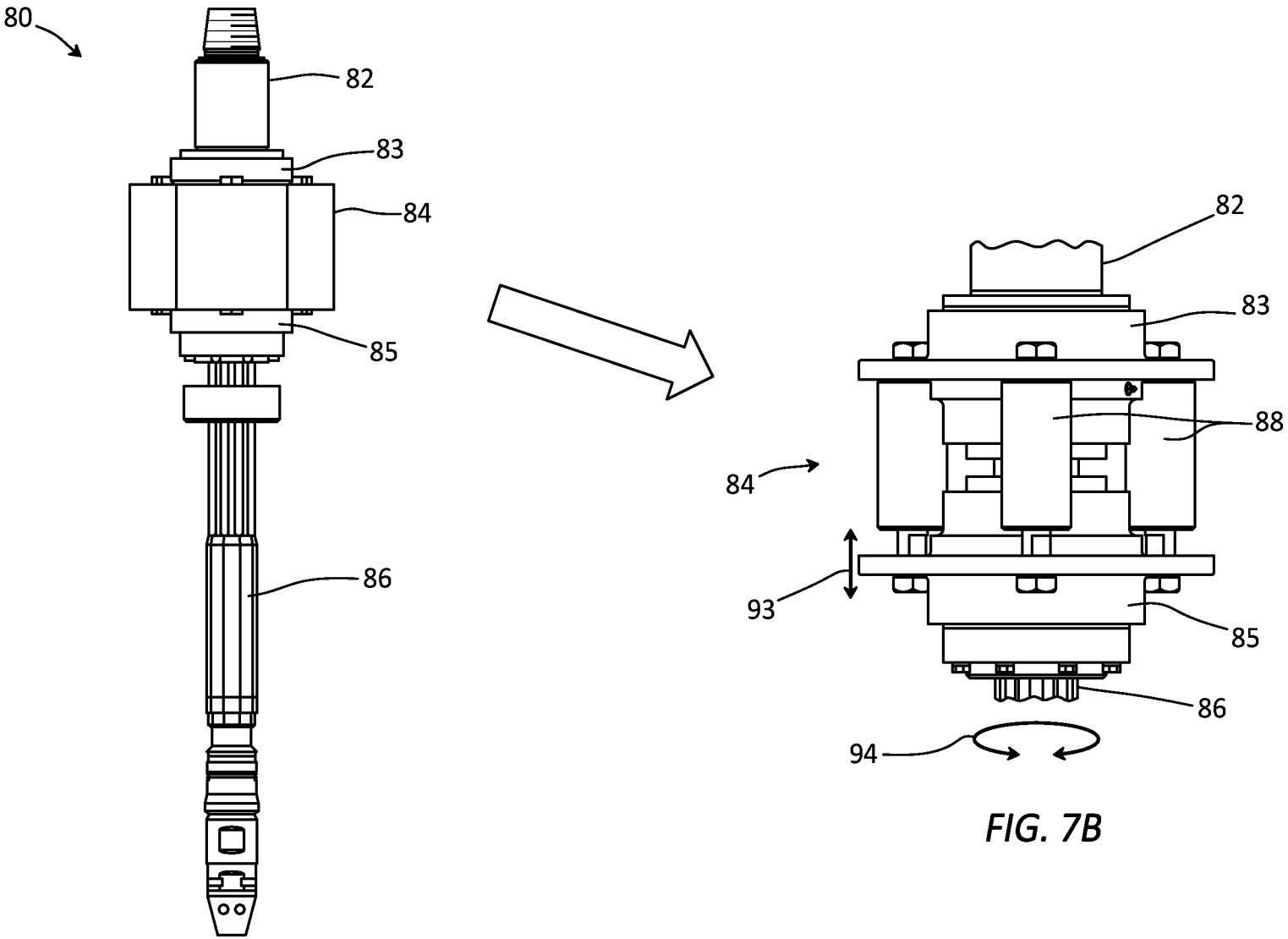
FIG. 7A is a representative front view of a running tool that can be coupled to a top drive for manipulating tubulars, in accordance with certain embodiments.
FIG. 7B is a representative front view of an actuator of the running tool that can cause the running tool to selectively engage or disengage a tubular, in accordance with certain embodiments.

FIG. 7A is a representative front view of a running tool 80 that can be coupled to a top drive 40 for manipulating tubulars 38 (e.g., casing segments). In a non-limiting embodiment, the actuator 84 can be rotationally fixed to the backup wrench positioner 110 and can receive electric power from the ESS 190 or generator 180 via conductors that can be routed from the backup wrench positioner 110 to the actuator 84 for powering the actuator 84. The quill interface 82 can be coupled to the quill 42 via one or more subs such that the quill interface 82 will rotate with the quill 42. The quill interface 82 is rotationally coupled to the actuator 84, such that when the quill 42 rotates, the quill interface 82 will rotate relative to the actuator 84. When the actuator 84 is actuated, the tubular interface 86 can be radially expanded to engage in the internal bore of a tubular 38. Deactivating the actuator 84 can radially retract the tubular interface 86 and disengage from the internal bore of a tubular 38.

FIG. 7B is a representative front view of an actuator 84 of the running tool 80 that can cause the running tool 80 to selectively engage/disengage a tubular 38. In a non-limiting embodiment, the actuator 84 can include multiple electric actuators 88 that can cooperate together to axially move (arrows 93) the lower portion 85 relative to the upper portion 83. When the lower portion 85 is moved toward the upper portion 83, the tubular interface 86 can be radially enlarged to engage the tubular 38. When the lower portion 85 is moved away from the upper portion 83, the tubular interface 86 can be radially retracted to disengage the tubular 38. The quill interface 82 and the tubular interface 86 can rotate (arrows 94) with the quill 42 relative to the actuator 84.

Figure 8:
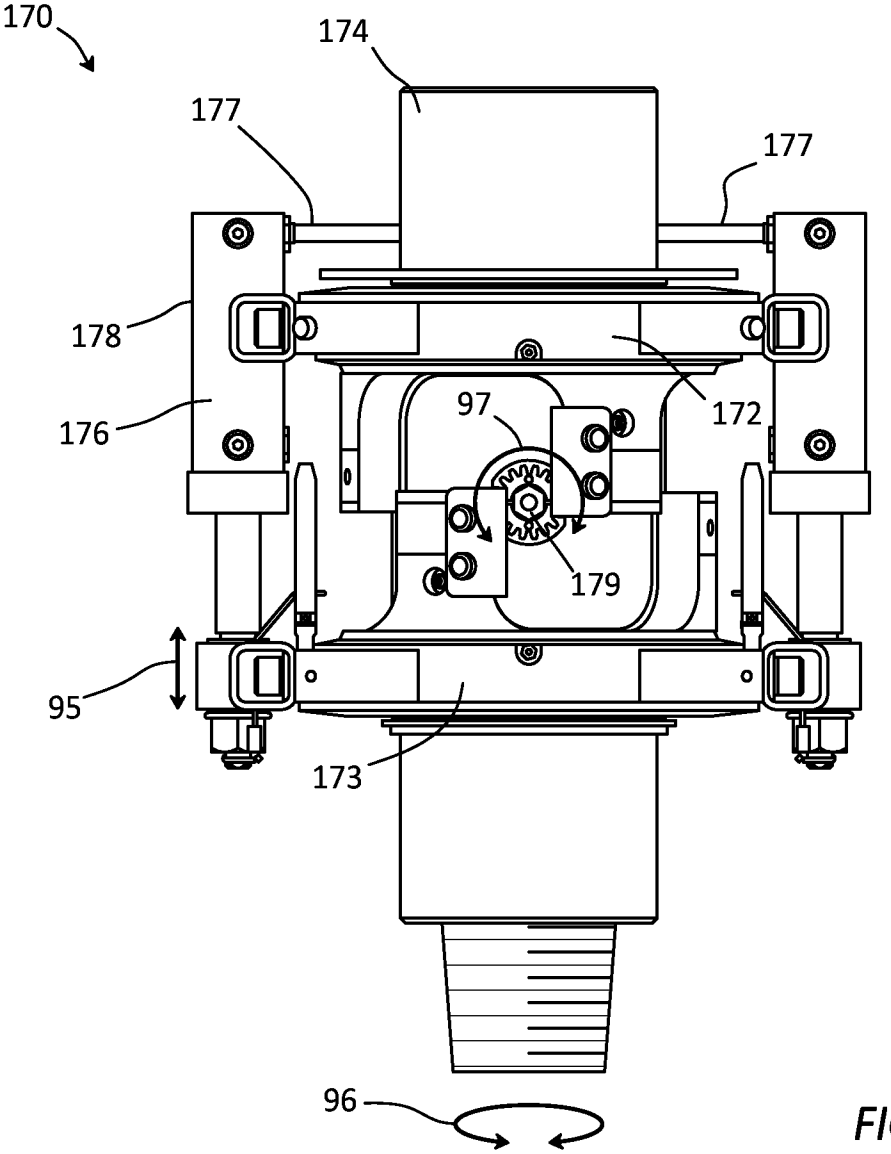
FIG. 8 is a representative front view of a lower well control valve that can be coupled to a top drive for controlling the flow of fluid through a tubular string during subterranean operations, in accordance with certain embodiments.

FIG. 8 is a representative front view of a lower well control valve (LWCV) 170 that can be coupled to a top drive 40 for controlling the flow of fluid through a tubular string 28 during subterranean operations. In a non-limiting embodiment, the LWCV 170 can include a rotary portion 174 that can be coupled to the quill 42 (e.g., via one or more subs) and a stationary portion 178 can be coupled to the backup wrench positioner 110, such that when the quill 42 is rotated, the rotary portion 174 is rotated (arrows 96) with the quill 42 and relative to the stationary portion 178. The stationary portion 178 can receive electric power from the ESS 190 or generator 180 via conductors 177 that can be routed from the backup wrench positioner 110 to the stationary portion 178 for powering the actuators 176. The stationary portion 178 can include multiple actuators 176 that can cooperate together to axially move (arrows 95) the lower portion 173 relative to the upper portion 172. When the lower portion 173 is moved toward the upper portion 172, the valve 179 can be rotated (arrows 97) to close the valve 179 to prevent fluid flow through the rotary portion 174. When the lower portion 173 is moved away from the upper portion 172, the valve 179 can be rotated (arrows 97) to open the valve 179 to allow fluid flow through the rotary portion 174.

VARIOUS EMBODIMENTS

Embodiment 1. A top drive comprising:
a main body portion comprising a quill that is rotatable relative to the main body portion;
a rotary portion that rotates relative to the main body portion and relative to the quill; and
a component coupled to the rotary portion, wherein the component rotates with the rotary portion, and wherein the component is electrically actuated.

Embodiment 2. The top drive of embodiment 1, wherein the component is a backup wrench, and wherein the backup wrench is electrically actuated to selectively engage or disengage rig equipment to couple the rig equipment to or uncouple the rig equipment from the quill.

Embodiment 3. The top drive of embodiment 2, wherein the rig equipment comprises a tubular, a running tool, or a sub.

Embodiment 4. The top drive of embodiment 1, wherein the component is a backup wrench positioner that is electrically operated to axially position a backup wrench in the rotary portion.

Embodiment 5. The top drive of embodiment 1, wherein the component is a lower well control valve that is electrically operated to prevent or allow fluid flow through the lower well control valve.

Embodiment 6. The top drive of embodiment 1, wherein the component is a running tool that is electrically operated to engage or disengage a tubular.

Embodiment 7. The top drive of embodiment 1, wherein the component is an elevator that is electrically operated, and wherein the elevator is coupled to the rotary portion via a pair of links.

Embodiment 8. The top drive of embodiment 7, wherein the component is a link tilt actuator that is electrically operated to tilt the pair of links away from or toward a center axis of the quill.

Embodiment 9. The top drive of embodiment 1, wherein the main body portion comprises a brake actuator that is electrically operated, and wherein the brake actuator selectively restricts rotation of the quill.

Embodiment 10. The top drive of embodiment 1, wherein the main body portion comprises a thread compensation actuator that is electrically operated, and wherein thread compensation actuator compensates for axial movement of the top drive when a tubular is threaded into or unthreaded from a tubular string.

Embodiment 11. The top drive of embodiment 1, wherein the main body portion comprises a handler motor that is electrically operated, and wherein the handler motor rotates the rotary portion relative to the main body portion.

Embodiment 12. The top drive of embodiment 1, wherein the rotary portion further comprises a generator that generates electric power and supplies the electric power to the component.

Embodiment 13. The top drive of embodiment 12, wherein the generator comprises a rotor coupled to and driven by the quill and a stator that is coupled to a backup wrench, and wherein rotation of the quill rotates the rotor relative to the stator and produces electric power that is supplied to the component and operates the component.

Embodiment 14. The top drive of embodiment 13, wherein the electric power is supplied to an energy storage system which stores at least a portion of the electric power, and wherein the energy storage system supplies the portion of the electric power to the component to operate the component.

Embodiment 15. The top drive of embodiment 12, wherein the generator is a hydraulically powered generator, and wherein pressurized hydraulic fluid drives the hydraulically powered generator to produce electric power, and wherein the electric power is supplied to the component and operates the component.

Embodiment 16. The top drive of embodiment 1, wherein conductors are electrically coupled between the main body portion and the rotary portion, and wherein the conductors supply an electric power to the component in the rotary portion.

Embodiment 17. The top drive of embodiment 16, wherein the electric power actuates the component.

Embodiment 18. The top drive of embodiment 16, wherein the rotary portion rotates up to 359 degrees relative to the main body portion of the top drive.

Embodiment 19. The top drive of embodiment 16, wherein the conductors are removably connected to the rotary portion via a connector.

Embodiment 20. The top drive of embodiment 16, wherein the conductors transfer at least one of command, control, and data signals between the rotary portion and the main body.

Embodiment 21. A system for performing subterranean operations, the system comprising a top drive slidably coupled to a rig, wherein the top drive is any one of the top drives described in this disclosure.

Embodiment 22. A method for performing subterranean operations, the method comprising electrically operating a top drive to perform a subterranean operation, the top drive comprising any one of the top drives described in this disclosure.

While the present disclosure may be susceptible to various modifications and alternative forms, specific embodiments have been shown by way of example in the drawings and tables and have been described in detail herein. However, it should be understood that the embodiments are not intended to be limited to the particular forms disclosed. Rather, the disclosure is to cover all modifications, equivalents, and alternatives falling within the spirit and scope of the disclosure as defined by the following appended claims. Further, although individual embodiments are discussed herein, the disclosure is intended to cover all combinations of these embodiments.

What is claimed is:

1. A top drive comprising:
a main body portion comprising a quill that is rotatable relative to the main body portion;
a rotary portion that rotates relative to the main body portion and relative to the quill, wherein the rotary portion rotates about a center axis of the quill; and
a component coupled to the rotary portion, wherein the component rotates with the rotary portion, wherein the component is electrically actuated, and wherein the rotary portion further comprises a generator that generates electric power from hydraulic fluid flow or from rotation of the quill.

2. The top drive of claim 1, wherein the component is a backup wrench, and wherein the backup wrench is electrically actuated to selectively engage or disengage rig equipment to couple the rig equipment to or uncouple the rig equipment from the quill.

3. The top drive of claim 2, wherein the rig equipment comprises a tubular, a running tool, or a sub.

4. The top drive of claim 1, wherein the component is a backup wrench positioner that is electrically operated to axially position a backup wrench in the rotary portion.

5. The top drive of claim 1, wherein the component is a lower well control valve that is electrically operated to prevent or allow fluid flow through the lower well control valve.

6. The top drive of claim 1, wherein the component is a running tool that is electrically operated to engage or disengage a tubular.

7. The top drive of claim 1, wherein the component is an elevator that is electrically operated, and wherein the elevator is coupled to the rotary portion via a pair of links.

8. The top drive of claim 7, wherein the component is a link tilt actuator that is electrically operated to tilt the pair of links away from or toward a center axis of the quill.

9. The top drive of claim 1, wherein the main body portion comprises a brake actuator that is electrically operated, and wherein the brake actuator selectively restricts rotation of the quill.

10. The top drive of claim 1, wherein the main body portion comprises a thread compensation actuator that is electrically operated, and wherein thread compensation actuator compensates for axial movement of the top drive when a tubular is threaded into or unthreaded from a tubular string.

11. The top drive of claim 1, wherein the main body portion comprises a handler motor that is electrically operated, and wherein the handler motor rotates the rotary portion relative to the main body portion.

12. The top drive of claim 1, wherein the generator supplies the electric power to the component.

13. The top drive of claim 12, wherein the generator comprises one of a rotor and a stator coupled to and driven by the quill and the other one of the rotor and the stator that is coupled to a backup wrench, and wherein rotation of the quill rotates the one of the rotor and the stator relative to the other one of the rotor and the stator and produces electric power that is supplied to the component and operates the component.

14. The top drive of claim 13, wherein the electric power is supplied to an energy storage system which stores at least a portion of the electric power, and wherein the energy storage system supplies the portion of the electric power to the component to operate the component.

15. The top drive of claim 12, wherein the generator is a hydraulically powered generator, and wherein pressurized hydraulic fluid drives the hydraulically powered generator to produce electric power, and wherein the electric power is supplied to the component and operates the component.

16. The top drive of claim 1, wherein conductors are electrically coupled between the main body portion and the rotary portion, and wherein the conductors supply an electric power to the component in the rotary portion.

17. The top drive of claim 16, wherein the electric power actuates the component.

18. The top drive of claim 16, wherein the rotary portion rotates up to 359 degrees relative to the main body portion of the top drive.

19. The top drive of claim 16, wherein the conductors are removably connected to the rotary portion via a connector.

20. The top drive of claim 16, wherein the conductors transfer at least one of command, control, and data signals between the rotary portion and the main body portion.

* * * * *